United States Patent [19]

Sato et al.

[11] 4,206,731

[45] Jun. 10, 1980

[54] EXHAUST GAS RECIRCULATION FOR AN INTERNAL COMBUSTION ENGINE

[75] Inventors: Yasushi Sato; Hidemi Onaka, both of Susono, Japan

[73] Assignee: Toyota Jidosha Kogyo Kabushiki Kaisha, Toyota, Japan

[21] Appl. No.: 968,916

[22] Filed: Dec. 13, 1978

[30] Foreign Application Priority Data

Sep. 13, 1978 [JP] Japan ..... 53/111735

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,041,917 | 8/1977 | Suzuki | 123/119 A |
| 4,092,960 | 6/1978 | Nohira et al. | 123/119 A |
| 4,128,090 | 12/1978 | Aoyama | 123/119 A |
| 4,137,874 | 2/1979 | Otsubo et al. | 123/119 A |
| 4,149,503 | 4/1979 | Ozaki et al. | 123/119 A |
| 4,150,649 | 4/1979 | Gropp | 123/119 A |

*Primary Examiner*—Wendell E. Burns

*Attorney, Agent, or Firm*—Kenyon & Kenyon

[57] ABSTRACT

A back pressure control type EGR system wherein a vacuum line for connecting an EGR port with a vacuum operated EGR valve for controlling the amount of the recirculated exhaust gas is selectively opened to an air chamber of a vacuum modulator valve responsive to the pressure of the recirculated exhaust gas. The air chamber is connected, via a vacuum line, to a second vacuum port located slightly above the EGR port. A vacuum switching valve responsive to vacuum pressure at a third port formed in an intake manifold is arranged in the vacuum line.

5 Claims, 3 Drawing Figures

EXHAUST GAS RECIRCULATION FOR AN INTERNAL COMBUSTION ENGINE

FIELD OF THE INVENTION

The present invention relates to an improvement of a so-called back pressure control type EGR system for an internal combustion engine.

BACKGROUND OF THE INVENTION

A back pressure control type EGR system is provided with a vacuum-operated flow control valve located on a recirculation passageway connecting an exhaust manifold of the engine with an intake manifold of the engine, and a vacuum modulator valve having a control chamber normally opened to the atmosphere. The control chamber is, in response to the pressure of the exhaust gas in a small space formed in the recirculation passageway, opened to a vacuum line connecting the flow control chamber with an EGR port formed in an intake passageway of the engine. This system makes it possible to maintain a predetermined constant pressure of the exhaust gas in the constant pressure space, which pressure is near atmospheric air pressure, as is well known to those skilled in this art. Thus, a predetermined constant ratio of the amount of the recirculated exhaust gas to the total amount of fluid directed to the engine combustion chamber (so-called EGR ratio) is obtained at every throttle opening or load of the engine.

The prior art back pressure control type EGR system has, however, a drawback in that an adverse effect easily takes place under a low or a high load condition of the engine, when a large amount of exhaust gas is recirculated for effectively decreasing the amount of $NO_x$ components in the exhaust gas. Under a low load condition "surging" easily takes place due to a large amount of inert gas composed of the combustion gas remaining in the combustion chamber because such combustion gas is not exhausted during the previous combustion cycle, and of the recirculated gas. Under the high load condition, a stable operation of the engine is not carried out due to a small output efficiency when the EGR ratio is high.

Therefore, in order to obtain a high EGR effect while preventing adverse effects from occurring, it is necessary to control the EGR operation so that the EGR ratio has a maximum value when the load of the engine is medium.

SUMMARY OF THE INVENTION

An object of the present invention is to provide an EGR system for an internal combustion engine, capable of recirculating a large amount of exhaust gas while preventing any adverse effects from being generated.

According to the present invention, an exhaust gas recirculation system of an internal combustion engine, having an engine body, an intake device connected to the engine body, a throttle valve arranged in the intake device, and an exhaust device connected to the engine body is provided. The system comprises: passageway means connecting the exhaust device with the intake device for recirculating a part of exhaust gas from the exhaust device to the intake device; flow control valve means arranged in the passageway means and having vacuum actuator means for controlling the opening of the valve means; vacuum conduit means connecting a first vacuum source formed in the intake device at a position slightly upstream of the throttle valve in its idle condition; means for forming a space of a predetermined small volume in the passageway means at a position located between the flow control valve means and the exhaust device; modulator means having a control chamber which is, in accordance with the pressure of the exhaust gas in the space, selectively opened to the vacuum conduit means for controlling the vacuum level in the actuator means; and vacuum control means responsive to the load of the engine for selectively introducing a vacuum signal into the control chamber from a second vacuum source formed in the intake device at a position located slightly upstream of the first vacuum source.

BRIEF DESCRIPTION OF THE APPENDED DRAWINGS

DETAILED DESCRIPTION OF PREFERRED EMBODIMENTS

Figure 1:
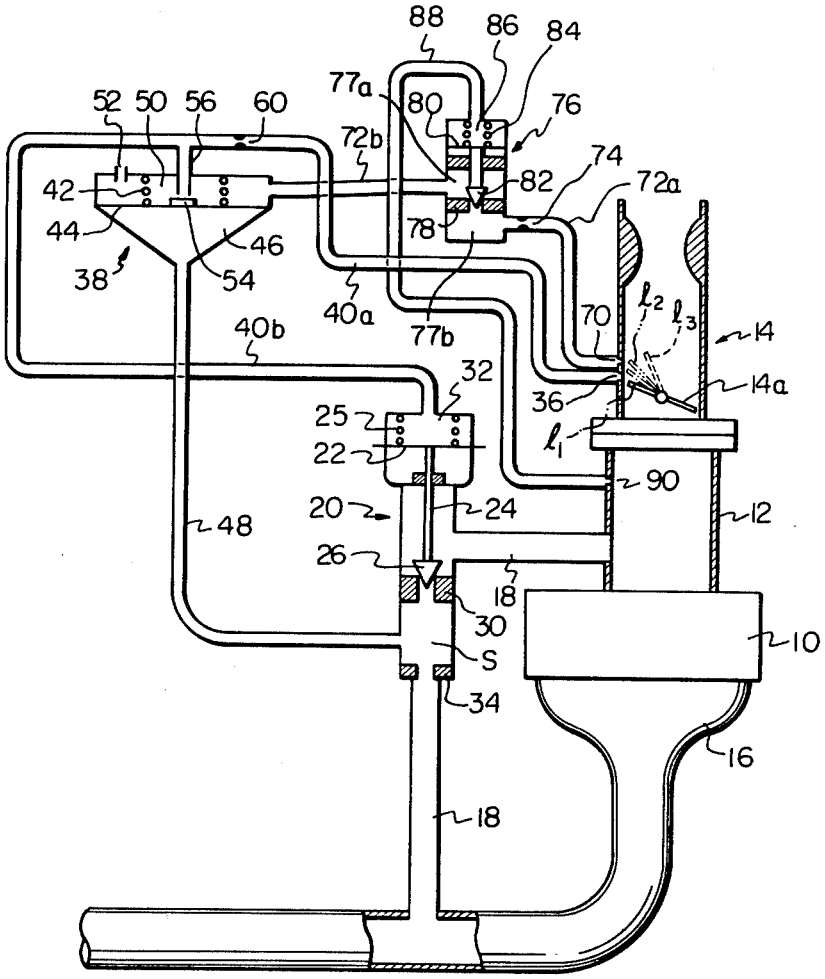
FIG. 1 is a diagrammatic view of an internal combustion engine provided with a back pressure control type EGR system of the present invention.

Referring to FIG. 1 which illustrates an embodiment of the present invention, an internal combustion engine comprises an engine body 10, an intake manifold 12 connected to combustion chambers (not shown) in the engine body 10, a carburetor 14 connected to the intake manifold 12 for generating a flow of intake air directed to the combustion chambers, and an exhaust manifold 16 connected to the combustion chambers for receiving the resultant exhaust gas therefrom. The reference numeral 18 designates an exhaust gas recirculation (EGR) passageway connecting the exhaust manifold 16 with the intake manifold 12. A flow control valve 20 is adapted for controlling the amount of recirculated exhaust gas passing through the EGR passageway 18 to the intake manifold 12. The flow control valve 20 is of a vacuum operated type and is comprised of a diaphragm 22, a valve rod 24 having one end connected to the diaphragm 22, and a valve member 26 connected to the other end of the valve rod 24. The flow control valve 20 further comprises a spring 25 and a valve seat 30 formed in a valve casing 31. The spring 25 urges the diaphragm 22 so that the valve member 26 is moved toward the valve seat 30. A vacuum chamber 32 is formed above the diaphragm 22, so that vacuum pressure in the chamber 32 can control the opening between the valve member 26 and the valve seat 30, in order to control the amount of recirculated exhaust gas.

A back pressure control throttle 34 is located slightly below or upstream of the valve seat 30 for restricting the flow area of recirculated exhaust gas directed to the valve seat 30. Therefore, a constant pressure chamber S of a relatively small volume is formed between the valve seat 30 and the throttle 34.

A reference numeral 36 is a vacuum signal port (so-called EGR port) formed in the carburetor barrel at a position located slightly above the throttle valve **14*a* when the throttle valve 14*a* is in its idle condition. The vacuum actuated flow control valve 20 is operated by vacuum pressure at the EGR port 36** as will be fully described later.

A back pressure control type EGR system of the present invention is provided with, in addition to the flow control valve 20, a modulator valve 38 for controlling the level of the vacuum in the chamber 32 of the valve 20 in accordance with the positive pressure of the recirculated exhaust gas in the constant pressure chamber S. The modulator valve 38 is provided with a diaphragm 44 and a spring 42 for urging the diaphragm 44 so that it moves downwardly. A back pressure chamber 46 is formed on one side of the diaphragm 44 opposite to the spring 42, which chamber 46 is connected to the constant pressure space S by means of an exhaust gas pressure conduit 48. An air chamber 50, in which the spring 42 is arranged, is opened to the atmosphere through an orifice 52. A valve member 54 is fixed to the diaphragm 44 at the middle portion thereof. The reference numeral 56 designates a vacuum control pipe having one end located between a vacuum conduit 40*a* connected to the EGR port 36 and another vacuum conduit 40*b* connected to the chamber 32. The other end of the pipe 56 is, by the valve member 54, selectively opened to the air chamber 50, for controlling the vacuum level in the chamber 32 of the EGR valve 20. The pipe 40*a* is provided with an orifice 60 for controlling the flow of fluid directed from the EGR port 36 to the EGR valve 20.

The valve member 54 is moved upwardly against the force of the spring 42 on moved downwardly by the force of the spring 42 in accordance with the pressure of the constant space S which communicates with the chamber 46 formed below the diaphragm 44. Thus, the air in the chamber 50 of the modulator is selectively introduced into the vacuum line located between the orifice 60 and the chamber 32 of the EGR valve 20. Thus, the vacuum pressure in the chamber 32 is controlled so that pressure of the exhaust gas in the space S is maintained at a pressure close to atmospheric pressure.

In addition to the above-mentioned parts, which are also provided in a conventional back pressure EGR system, the present invention is further provided with means for effecting the control of EGR ratio in accordance with the load of the engine. As shown in FIG. 1, a second vacuum signal port 70 is formed in the carburetor at a position slightly above the EGR port 36. The second vacuum port 70 is connected to the air chamber 50 of the vacuum modulator valve 38 by means of a vacuum conduit 72*a*, a vacuum switching valve 76 and another vacuum conduit 72*b*. A second orifice 74 is formed in the pipe vacuum pipe 72*a* for controlling the speed of the introduction of a vacuum signal from the second port 70 to the chamber 50 of the vacuum modulator 38. The vacuum switching valve 76 of the vacuum operated type is adapted for response to the load of the engine for controlling the fluid communication between the vacuum pipes 72*a* and 72*b*. The valve 76 has a first chamber 77*a* formed on one side of a valve seat 78, connected to the pipe 72*b*, and a second chamber 77*b* formed on the other side of the valve seat 78, connected to the pipe 72*b*. The valve 76 further has a valve member 82 connected to a vacuum actuator including a diaphragm 80. The diaphragm 80 is urged by a spring 84 so that the valve member 82 is moved toward the valve seat 78. On one side of the diaphragm remote from the valve member 82, a vacuum chamber 86 is formed. The vacuum chamber 86 is, via a vacuum pipe 88, connected to a vacuum port 90 formed in the intake manifold 12. The vacuum level at the port 90 varies in response to the opening of the throttle valve, i.e., the load of the engine. The operation of the system of FIG. 1 will now be described.

LOW LOAD CONDITION

In a low load condition, the throttle valve 14*a* is opened from the idle position so that it is located above the EGR port 36 as shown by a line $l_1$, in FIG. 1. In this case, a vacuum at the port 90 opened to the chamber 86 of the vacuum switching valve 76 is strong enough to cause the diaphragm 80 to be displaced upwardly against the force of the spring 84. Thus, the valve member 82 is detached from the valve seat 78 for connecting the valve chambers 77*a* and 77*b* with each other, for allowing fluid connection between the EGR port 36 and the chamber 32 of the EGR valve 20. Furthermore, in the low load condition wherein the throttle valve 14*a* is located as shown by the line $l_1$, the second port 70 is under a pressure close to atmospheric pressure. Thus, introduction of air into the chamber 50 of the modulator valve 38 is controlled not only by the orifice 52 and but also by the orifice 74. Thus, a large amount of air is introduced into the vacuum line between the orifice 60 and the chamber 32 of the EGR valve 20 when the valve member 54 is detached from the control pipe 56, in order to decrease the effect of the vacuum in the chamber 32. Thus, the flow area formed between the valve member 26 and the valve member 30 is small; therefore, the amount of the recirculated gas passing through the EGR valve 20 is small. The small flow area together with the substantially atmospheric pressure in the constant space S makes it possible to obtain a ratio of the amount of the recirculated exhaust gas introduced into the intake manifold 12 to the amount of the total fluid introduced to the engine body 10 (EGR ratio) which is as small as E, shown in FIG. 2.

MEDIUM LOAD CONDITION

When the throttle valve 14*a* is opened from the position $l_1$, so that it is located slightly above the second port 70 as shown by a line $l_2$ in FIG. 1, a vacuum at the port 90 is still strong enough to cause the diaphragm 80 to be displaced upwardly against the force of the spring 84. Therefore, a fluid connection between the second port 70 and the control chamber 50 of the modulator 30 is still attained. In the medium load condition, the throttle valve 14*a* is located above the second port 70 as shown by the line $l_2$ in FIG. 1. Thus, a vacuum signal from the second port 70 is transmitted to the chamber 50 via the pipe 72*a*, the vacuum switching valve 76 and the pipe 72*b*. Thus, the amount of air introduced into the vacuum control pipe 56 from the air chamber 50 is decreased in the medium load condition when compared with that in the low load condition. Thus, the amount of air introduced into the vacuum line between the orifice 60 and the chamber 32 becomes small, in order to increase the effect of the vacuum in the chamber 32. Thus, the flow area between the valve member 26 and the valve seat 30, i.e., the amount of recirculated exhaust gas passing through the EGR line is increased. The EGR ratio during the medium load condition is, thus, as high as $E_2$ in FIG. 2.

HIGH LOAD CONDITION

When the throttle valve is opened from the position shown by the line $l_2$ to a position shown by a line $l_3$ in FIG. 1, the vacuum level at the third port 90 communicating with the chamber 86 is low enough to cause the diaphragm 80 to be displaced downwardly under the force of the spring 84. Thus, the valve member 82 is rested on the valve seat 78, causing the valve chambers 77*a* and 77*b* to be disconnected from each other. Therefore, the introduction of the vacuum signal from the second port 70 into the chamber 50 of the modulator 38 is prevented. Thus, the amount of air introduced into the vacuum line located between the orifice 60 and the chamber 32 is determined by the orifice 52. Thus, the vacuum level at the chamber 32 of the EGR valve 20 is decreased, thereby causing the valve member 26 to move toward the valve seat 30. Thus, the EGR ratio is as small as $E_3$ in FIG. 2.

Figure 2:
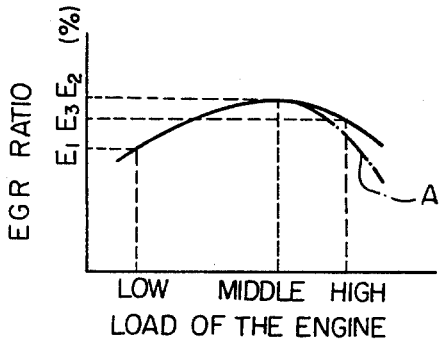
FIG. 2 is a graph showing relations between the throttle opening and the EGR ratio of the EGR system shown in FIG. 1.

As is clear from the above description, the present invention makes it possible to obtain an EGR characteristic curve wherein a maximum EGR ratio is obtained when the load of the engine is medium, as shown in FIG. 2. Therefore, the EGR operation is not adversely affected when the engine load is low or high, it is possible to while recirculating a sufficiently large enough amount of exhaust gas for effectively decreasing the emission of $NO_x$ components from the engine.

Figure 3:
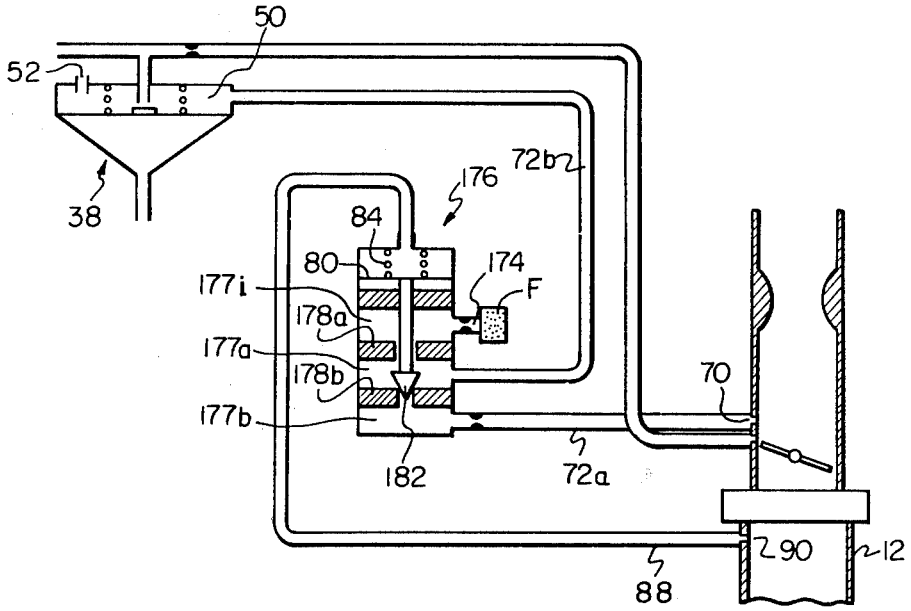
FIG. 3 is a diagrammatic view which partly shows another embodiment of the invention.

A second embodiment of the present invention, which is partly shown in FIG. 3, has a vacuum switching valve 176 which is slightly modified when compared with the valve 76 shown in FIG. 1. The valve 176 has three valve chambers 177*a*, 77*b* and 177*c*. The first or common chamber 177*a* formed between a pair of spaced apart valve seats 178*a* and 178*b* is connected via the vacuum conduit 72*b* to the chamber 50 of the modulator 38. The second chamber 177*b* is connected via the vacuum conduit 72*a* to the second vacuum port 70. The third chamber 177*c* is connected to the atmosphere via an air filter F. An orifice 174 is arranged between the chamber 177*c* and the air filter F. A valve member 182 is arranged between the valve seats 178*a* and 178*b*, and is connected to the diaphragm 80 which is urged by the spring 84 for controlling the position of the valve member 182 with respect to the valve seats 178*a* and 178*b* in response to the vacuum pressure at the port 90.

When the vacuum pressure at the port 90 is sufficiently strong enough to move the diaphragm upwardly against the force of the spring 84, the valve member 182 is rested on the valve seat 178*a*, allowing the common chamber 177*a* to communicate with the second chamber 177*b*. Thus, the second port 70 can communicate with the chamber 50 of the modulator 38. Therefore, the EGR characteristic, when the valve member 182 is rested on the valve seat 178*a*, i.e., when the engine is operating under the low or the medium load condition, substantially conforms to the curve shown in FIG. 2.

When the vacuum pressure at the port 90 is small enough to cause the valve member 182 to be rested on the valve seat 178*b*, i.e., when the engine is operating under the high load condition, the common chamber 177*a* communicates with the third chamber 177*c*. Thus, the chamber 50 is, when the engine is operating under the high load condition, connected to the atmosphere not only through the orifice 52 but also through the orifice 174. Therefore, the EGR ratio during the high load condition in the embodiment of FIG. 3, as shown by the dotted line A in FIG. 2, is smaller than the EGR ratio in the embodiment of FIG. 1.

While embodiments of the present invention are described with reference to the attached drawings, many modifications and changes can be made by those skilled in this art.

What is claimed is:

1. As exhaust gas recirculation system of an internal combustion engine having an engine body, an intake device connected to said engine body, a throttle valve arranged in said intake device, and an exhaust device connected to said engine body, said system comprising:

passageway means connecting said exhaust device with said intake device for recirculating a part of exhaust gas from said exhaust device to said intake device;

flow control valve means arranged in said passageway means and having vacuum actuator means for controlling the opening of said valve means;

vacuum conduit means connecting a first vacuum source formed in said intake device at a position slightly upstream of said throttle valve in its idle condition;

means for forming a space of a predetermined small volume in said passageway means at a position located between said flow control valve means and said exhaust device;

modulator means having a control chamber which is, in accordance with pressure of the exhaust gas in said space, selectively opened to said vacuum conduit means for controlling the vacuum level in said actuator means; and vacuum control means responsive to the load of said engine for selectively introducing a vacuum signal into said control chamber from a second vacuum source formed in said intake device at a position located slightly upstream of said first vacuum source.

2. An exhaust gas recirculation system according to claim 1, wherein said vacuum control means comprises: valve means having a first and second valve chambers which are selectively connected with each other in accordance with the load of said engine; a first passageway means connecting said first valve chamber with said control chamber of said modulator means; and a second passageway means connecting said second valve chamber with said second vacuum source.

3. An exhaust gas recirculation system according to claim 2, wherein said valve means comprises a diaphragm operated valve responsive to a vacuum pressure in said intake device at a position which is always located downstream of said throttle valve.

4. An exhaust gas recirculation system according to claim 1, wherein said vacuum control means comprises: valve means having a first, a second and a third valve chambers, said valve means is, in accordance with the load of said engine, switched between a first position where said first valve chamber is connected to said second valve chamber and a second position where said first valve chamber is connected to said third valve chamber; a first vacuum passageway means connecting said first valve chamber with said control chamber of said modulator means; a second passageway means for connecting said second valve chamber with the said second vacuum source, said third valve chamber being always opened to the atmosphere.

5. An exhaust gas recirculation system according to claim 4, wherein said valve means comprises a diaphragm operated valve responsive to a vacuum pressure in said intake device at a position always located downstream of said throttle valve.

* * * * *